US006004228A

United States Patent [19]

Adam

[11] Patent Number: 6,004,228

[45] Date of Patent: Dec. 21, 1999

[54] VENTED ANGULAR GOLF TEE

[76] Inventor: John M. Adam, 818 Colston Rd., Marietta, Ga. 30064

[21] Appl. No.: 09/046,838

[22] Filed: Mar. 24, 1998

[51] Int. Cl.[6] ..... A63B 57/00

[52] U.S. Cl. ..... 473/403

[58] Field of Search ..... 473/387–403

[56] References Cited

U.S. PATENT DOCUMENTS

| | | | |
|---|---|---|---|
| 2,018,146 | 10/1935 | Penny | 473/402 |
| 2,082,811 | 6/1937 | Thorup | 473/402 |
| 3,907,289 | 9/1975 | Bondu, Sr. | 473/403 |
| 4,192,504 | 3/1980 | Clugage | 473/403 |
| 4,205,841 | 6/1980 | Silva et al. | 473/396 |
| 4,951,945 | 8/1990 | Gamble | 473/402 |
| 5,413,330 | 5/1995 | Disclo et al. | 473/387 |

*Primary Examiner*—Steven Wong
*Attorney, Agent, or Firm*—Harry I. Leon; Vivian L. Steadman

[57] ABSTRACT

An improved angular golf tee made from a single unity piece of plastic which defines an elongated, ribbed body and a tapered structure with a shoulder. Distal ends of the ribbed body terminate in the shoulder and in a thin ring, respectively. Properly inserted into the earth, the tapered structure is disposed vertically; and the ribbed body is bent away from the vertical by an angle of about 30 degrees. This configuration allows one to direct the upper end of the ribbed body toward himself, so that there is less chance of the tee and any golf ball resting thereon being hit simultaneously. The ribbed body further defines a pair of open, elongated cavities between which protrudes an elongated, vertical, flat rib. The pair of elongated cavities and rib are capped by the thin ring which terminates upwardly in a horizontally-disposed rim. Sloping inwardly from the rim, the ring defines a concave hollow, whose curvature closely matches that of the exterior surface of a standard-size golf ball. Two notches are aligned with each other on opposite sides of the rim and are disposed in the same vertical plane as the rib. These notches allow air to flow freely into the hollow as the golf ball lifts off as does a slight distortion of the rim which occurs at the same time. The latter phenomenon, which substantially eliminates the effects of depressurization between the ball and tee, is caused by flexure of the outer walls of the elongated, open cavities as they expand due to wind currents generated by a golfer's swing.

5 Claims, 1 Drawing Sheet

VENTED ANGULAR GOLF TEE

BACKGROUND OF THE INVENTION

This invention relates generally to angular golf tees. An angular golf tee allows the face of a club to strike the golf ball obliquely without contacting the tee. This advantage has been known for a long time. As early as 1925, Getchell, in U.S. Pat. No. 1,554,721, disclosed an angular golf tee; and Bondu, in U.S. Pat. No. 3,907,289 which issued in 1975, improved upon it by making the lower part of the tee easier to insert into the ground.

Disco et al., in U.S. Pat. No. 5,413,330, which issued in 1995, disclose an angular golf tee with an additional improvement, specifically, a ventilation passageway through a side wall thereof. This passageway reduces the effects of depressurization between the tee and an accelerating golf ball so that the tee has a greater tendency to remain stationary after the golf ball has been struck. With such a ventilation passageway, a greater percentage of the momentum of the golf club can be transferred to the ball.

Nevertheless, the angular golf tee has yet to become popular with most golfers. This situation is due largely to the fact that each of the prior art angular golf tees has to be inserted into the ground at a precise angle. Otherwise, the tee cannot support a golf ball properly.

SUMMARY OF THE INVENTION

The object of this invention is to provide an improved angular golf tee which can be easily inserted into the earth and which is stable once it has been inserted there.

A further object of this invention is to provide an angular golf tee which tends to remain stationary even after a golf ball supported thereon has been struck and begins to accelerate away therefrom.

A further object of this invention is to provide an angular golf tee with means, including an improved vent, for balancing air forces which are caused by the swing of the club and which otherwise act so as to create a partial vacuum between the golf ball and the upper surface of the tee, tending to lift it from the ground with the ball when the latter is struck.

According to the present invention, the tee comprises a single, unitary piece of molded plastic having a ribbed body and an elongated, tapered structure with a shoulder. Distal ends of the ribbed body terminate in the shoulder and in a thin ring, respectively. The tapered structure, which by itself resembles a conventional golf tee, can be inserted into the earth as far as the shoulder and, when so inserted, is disposed vertically. Atop the tapered structure, the ribbed body bends away from the vertical, with the centerlines of the ribbed body and of the pointed structure being disposed at an obtuse angle—preferably about 150 degrees—to each other.

The underside of the ribbed body defines a vertical, flat rib juxtaposed between and protruding forwardly from a pair of open, elongated cavities. Strengthening the body, the rib extends generally from the shoulder of the tapered structure to the thin ring and, in use, from the ground to this ring.

Forming a transition from that portion of the ribbed body occupied by the pair of elongated cavities to the uppermost edge of this body is the thin ring; this ring terminates in a rim which is nearly circular in transverse cross-section. Sloping inwardly from the rim, the ring defines a concave hollow, whose curvature closely matches that of the exterior surface of a standard-size golf ball, so that as the ball rests on the rim, it is partially nested within the hollow. A protrusion which extends both horizontally from the rim and forwardly of the rib provides further stability for the resting ball.

To allow air to flow freely into the hollow as the golf ball lifts off immediately after being struck, the protrusion and rim together define a pair of chevron-shaped notches which are aligned with each other on opposite sides of the rim. In use, the chevron-shaped notches are pointed generally in the same direction as the golfer intends for the ball to move when struck. These notches allow air flow into the hollow so that the pressure there can be equalized rapidly, minimizing the effects of depressurization between the golf tee and an accelerating golf ball departing the golf tee. Without such means for equalizing the pressure, the tee itself might take flight with the golf ball.

In addition, as a departing golf ball begins to leave the hollow cavity, the outer walls of the elongated cavities below it flex outwardly, slightly distorting portions of the rim located perpendicularly to the rib. As this flexure occurs, the rib functions similarly to the backbone of an animal's chest cavity. The net effect is that air flows freely over the edge of the rim and into space vacated by the departing golf ball, further reducing the likelihood that the tee will be carried aloft with the golf ball.

DETAILED DESCRIPTION OF THE PREFERRED EMBODIMENT

Figure 1:
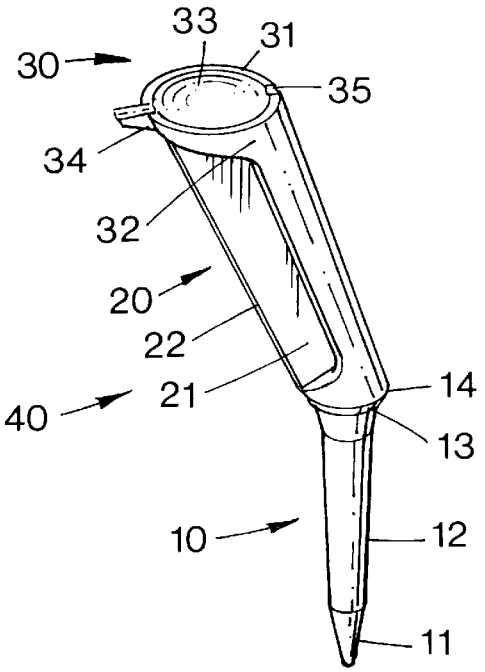
FIG. 1 is a top right side perspective view of the tee according to the present invention.

In the drawings, a tee 40 comprises a unitary piece of molded plastic having a tapered, earth-penetrating structure 10, a ribbed body 20 and a thin ring 30 terminating along a rim 31. The earth-penetrating structure 10 has a pointed tip 11, a tapered section 12 and a shoulder 13. Above a juncture 14, the structure 10 slants away from the ribbed body 20 at an angle which, in the preferred embodiment, measures about 30 degrees.

Figure 3:
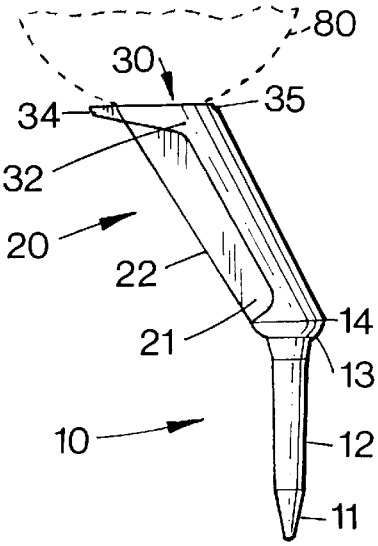
FIG. 3 is a right side elevational view, on a reduced scale, of the tee according to FIG. 1, the left side elevational view of the tee being a mirror image of FIG. 3; a fragmentary golf ball being shown in dashed lines for illustrative purposes only but not forming any part of the invention.
Figure 4:
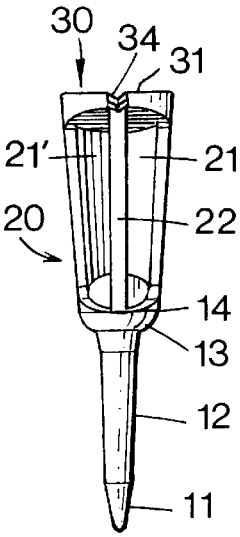
FIG. 4 is a front elevational view of the tee according to FIG. 1.
Figure 5:
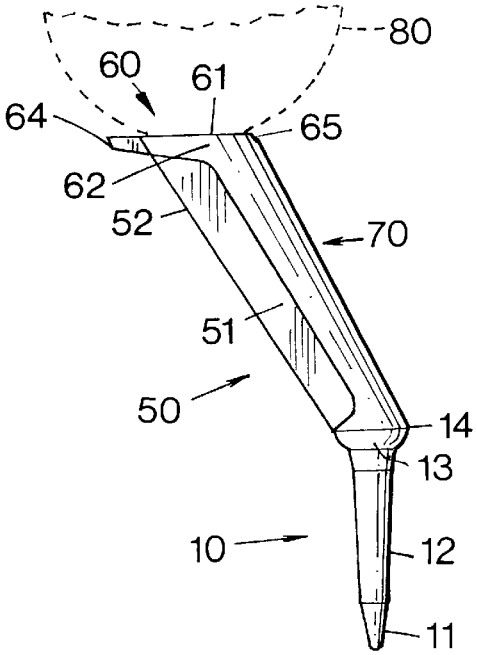
FIG. 5 is a right side elevational view of an alternate embodiment of the tee according to the present invention; a fragmentary golf ball being shown in dashed lines for illustrative purposes only but not forming any part of the invention.

As illustrated in FIGS. 1, 3 and 4, the underside of the ribbed body 20 defines a pair of elongated open cavities 21, 21' separated by a flat, vertically-disposed rib 22 which generally bisects an elongated curved side wall of the ribbed body longitudinally. In transverse cross-section, the curved side wall occupies an arc which leaves about one half of the rib 22 protruding outwardly relative to the cavities 21, 21' (FIG. 4). The vertical rib 22 not only strengthens the ribbed body 20 but also the thin ring 30.

Joined both to the rib 22 and to a transitional part 32 of the ribbed body 20, the ring 30 provides a concave surface on which to rest a golf ball 80. A hollow 33 defined by the ring 30 has a concavity which matches that of a standard-size golf ball 80, i.e., has a radius of curvature of about 0.85 inch. In the preferred embodiment, the rim 31 has an outer diameter which measures, by way of example, about 0.63 inch and an inner diameter of about 0.58 inch. The ring 30 also has a protrusion 34 formed thereon with a top surface at the same height as the rim 31. The protrusion 34, which extends horizontally in the same direction as does the rib 22, also helps to stabilize the resting ball 80.

Figure 2:
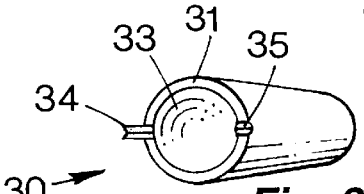
FIG. 2 is a top plan view of the tee according to FIG. 1.
Figure 6:
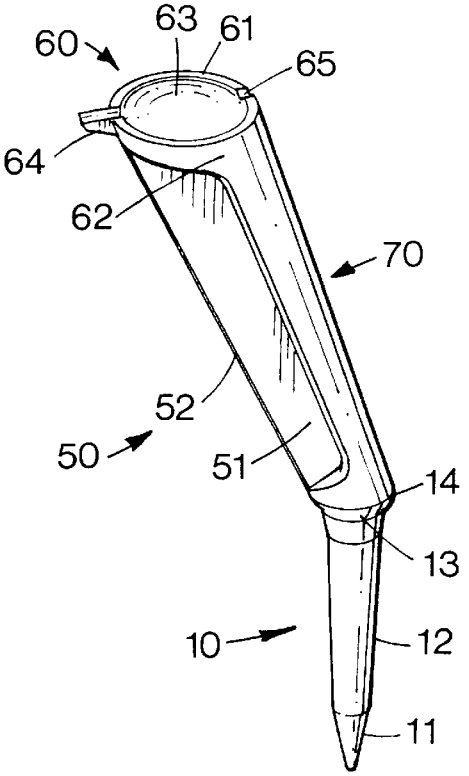
FIG. 6 is right side perspective view of the tee according to FIG. 5.

As is best seen in FIGS. 2 and 4, the protrusion 34 and rim 31 together define a pair of chevron-shaped notches; one of these is a notch 35 which is formed in the rim opposite a similar notch which extends from the rim across the top of the protrusion 34. In use, the chevron-shaped notches are pointed generally in the same direction as the golfer intends for the ball to move when it is struck. The notches comprise means for introducing air flow into the hollow 33 in such a way that the pressure there can be equalized rapidly, minimizing the effects of depressurization between the tee 40 and an accelerating golf ball as it departs the tee.

Formed as a single, unitary piece by molding a plastic, such as nylon or the like, the tee 40 preferably measures, by way of example, about 2.6 inches in overall length. About half of this length resides in the earth-penetrating, tapered structure 10 (FIG. 1). The thickness of the structure 10 increases gradually above the pointed tip 11 and then abruptly enlarges at the shoulder 13. Immediately below the shoulder 13, the structure 10 has a transverse cross-section with a diameter which measures, by way of example, 0.22 inch. The greatest transverse cross-section of the shoulder 13, on the other hand, has a diameter which is one-half again as large.

Above the shoulder 13, the elongated cavities 21, 21', are defined in part by a curved outer wall and the strengthening rib 22. Both this outer wall and the rib 22 have a wall thickness which, in the preferred embodiment, measures about 0.1 inch. Moreover, the rib 22 slowly increases in transverse width varying from about 0.4 inch proximate with the shoulder 13 to about 0.5 inch proximate with the thin ring 30.

In an alternate embodiment of the tee 70, a ribbed body 50 is provided which is similar to the ribbed body 20 except that the body 50 is a 0.5 inch longer, making the overall height of the tee 50 3.1 inches, with 1.8 inches being situated above ground during use. The thin ring 60 in this alternate embodiment is similar to the ring 30 in that the former includes a rim 61 and protrusion 64 extending horizontally therefrom as well as a concave hollow for supporting a resting golf ball 80. Chevron-shaped notches formed in the rim 61, including the notch 65 and one diametrically opposed to it which extends across both the rim and top of the protrusion 64, are also provided.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A tee for use with a golf ball, the tee being molded of a single, unitary piece of plastic, comprising:

(a) an elongated, tapered structure, the structure having a shoulder;

(b) means, including a thin ring which defines a rim and a concave hollow, for supporting the golf ball at rest; and (c) an elongated, ribbed body, distal ends of the ribbed body forming the thin ring and abutting the shoulder, respectively, the ribbed body being bent away from the vertical by an angle of about 30 degrees when the tapered structure is disposed vertically, the ribbed body defining a pair of open, elongated cavities and an elongated, flat rib juxtaposed therebetween; the pair of elongated cavities and the rib being capped by the thin ring, the ribbed body being thin-walled so that outer walls of the elongated, open cavities can flex and cause a slight distortion of the rim as they do so, thereby facilitating equalization of air pressure within the hollow as the golf ball is accelerated away from it.

2. The tee according to claim 1 wherein the thin ring further defines two notches which are disposed on opposing sides of the the rim and which lie generally within an imaginary plane which passes through and is disposed parallel to the flat rib.

3. The golf tee according to claim 1 wherein the rim is further characterized as defining a circular arc.

4. The golf tee according to claim 1 wherein the concave hollow is further characterized as having a curvature which allows the golf ball to be partially nested within the hollow.

5. A tee for use with a golf ball, comprising:

(a) an elongated, tapered structure, the structure having a shoulder;

(b) means, including a thin ring which defines a rim and a wall joined thereto which slopes inwardly and downwardly from the rim, for supporting the golf ball at rest; and (c) an elongated hollow body, distal ends of the hollow body forming the thin ring and abutting the shoulder, respectively, the hollow body being rigidly affixed to the shoulder, the hollow body being bent away from the vertical by an acute angle when the tapered structure is disposed vertically, the hollow body defining at least one elongated cavity capped by the thin ring, the elongated cavity defining an opening formed in one side of the hollow body, said opening being substantially as long as the cavity itself, the hollow body being thin-walled so that outer walls of the cavity can flex and cause a slight distortion of the rim as they do so, thereby minimizing suction forces between the tee and the golf ball as it is being accelerated away from the tee.

* * * * *